US005495220A

United States Patent [19]

Takaya et al.

[11] Patent Number: 5,495,220

[45] Date of Patent: Feb. 27, 1996

[54] IRON CORE RETAINING STRUCTURE OF ELECTROMAGNETIC CONTACTOR

[75] Inventors: Kouetsu Takaya; Kuniyuki Kogawa, both of Kanagawa, Japan

[73] Assignee: Fuji Electric Co., Ltd., Kanagawa, Japan

[21] Appl. No.: 360,885

[22] Filed: Dec. 21, 1994

[30] Foreign Application Priority Data

Dec. 22, 1993 [JP] Japan ..... 5-322961

[51] Int. Cl.[6] ..... H01F 7/13; H01F 7/08

[52] U.S. Cl. ..... 335/274

[58] Field of Search ..... 335/131, 131, 335/127, 257, 274, 277, 278, 281

[56] References Cited

U.S. PATENT DOCUMENTS 3,196,231 7/1965 Meyer .
3,467,921 9/1969 McGary .

FOREIGN PATENT DOCUMENTS 1374384 1/1965 France .
7107335 7/1971 Germany .
2411539A1 9/1975 Germany .
213787 2/1983 Germany .

OTHER PUBLICATIONS

European Search Report dated Apr. 26, 1995.

*Primary Examiner*—Leo P. Picard
*Assistant Examiner*—Raymond M. Barrera
*Attorney, Agent, or Firm*—Finnegan, Henderson, Farabow, Garrett & Dunner

[57] ABSTRACT

A structure for reducing impact force due to the collision of a movable iron core (4) against a fixed iron core (3), especially, impact force exerted against a bottom plate of a lower casing (2) where electromagnetic contactor mounting portions are provided. A back portion of the fixed iron core (3) is put on the bottom plate of the lower casing (2) through a convex leaf spring (14) which has opposite end portions bent at right angles to form lower pressure-receiving surfaces (14*a*) and side pressure-receiving surfaces (14*b*) so that the lower pressure-receiving surfaces (14*a*) and the side pressure-receiving surfaces (14*b*) are brought into contact with the bottom plate of the lower casing (2) and with side walls of the lower casing (2), respectively.

11 Claims, 5 Drawing Sheets

IRON CORE RETAINING STRUCTURE OF ELECTROMAGNETIC CONTACTOR

BACKGROUND OF THE INVENTION

The present invention relates to an iron core retaining structure of an electromagnetic contactor which switches on and off an electric source for an electrical equipment such as a motor.

In most cases, such an electromagnetic contactor has means for absorbing impact force produced when a movable iron core collides against a fixed iron core. FIG. 5 shows an example of a conventional electromagnetic contactor of this type. FIG. 5(*a*) is a sectional view of the electromagnetic contactor, and FIG. 5(*b*) is a sectional view of the same electromagnetic contactor in its making state, for explaining the operation of the electromagnetic contactor. In FIG. 5(*a*), a central leg of an E-shaped fixed iron core 3 is inserted into an exciting coil 5. A movable iron core 4 placed so as to be opposite to the fixed iron core 3 is connected to a movable contact support 6 through a connection plate 7 and supported by a return spring 8. The movable iron core 4 and the fixed iron core 3 are placed in a lower casing 2, with an upper portion of the movable iron core 4 left outside. The bottom portion of the fixed iron core 3 is mounted on a bottom plate of the lower casing 2 through an elastic sheet 13 such as a rubber material. An upper casing 1 defines, by its lower surface 1*a*, the upward moving distance of the movable contact support 6. A fixed contact 9 attached on the upper surface of the upper casing 1 is made to be opposite to a movable contact 10. The movable contact 10 is attached on the movable contact support 6 so as to be pressed by means of a contact spring 12. Electromagnetic contactor mounting portions 2*a* are provided on the lower casing 2.

When an exciting coil 5 is energized with an electric current, the fixed and movable iron cores 3 and 4 attract each other so that the movable iron core 4 moves to and collides against the fixed iron core 3. Consequently, as shown in the diagram (*b*) of FIG. 5, the movable contact 10 comes into contact with the fixed contact 9 to close an electric circuit connected between the fixed and movable contacts 9 and 10. When the current conduction is cut off, the movable iron core 4 is released so as to be moved away from the fixed iron core 3 by the return spring 8, so that the movable contact 10 is separated from the fixed contact 9 to open the electric circuit. When the movable iron core 4 collides against the fixed iron core 3, impact force is caused on the fixed iron core 3 and the movable iron core 4. Thus, the elastic sheet 13 is provided so that the fixed iron core 3 is pressed against the elastic sheet 13 and the elastic sheet 13 absorbs the impact force acting on the fixed iron core 3 because of its flexibility. The impact force acting on the movable iron core 4 is also absorbed when the impact force acting on the fixed iron core 3 is absorbed, whereby the contacts are prevented from chattering.

In the above-mentioned electromagnetic contactor, an elastic sheet such as a rubber material is disposed between the bottom portion of the fixed iron core and the bottom plate of the lower casing in order to absorb impact force due to the collision of the movable iron core against the fixed iron core. The quantity of flexion of the electric sheet is however small, so that the effect of absorption of the impact force is not always sufficient. Furthermore, the impact force acts on the bottom plate of the lower casing on which the electromagnetic contactor mounting portions are provided. Therefore, when the electromagnetic contactor is mounted on a panel, the impact given to the panel and noises are large, so that the adverse affect may be caused on other devices mounted on the panel.

SUMMARY OF THE INVENTION

An object of the present invention is to provide an iron core retaining structure of an electromagnetic contactor for reducing impact force due to the collision of a movable iron core against a fixed iron core at the time of making operation of the electromagnetic contactor, and for particularly reducing impact force acting on a bottom plate of a lower casing on which portions for mounting the electromagnetic contactor are provided, and for making it easy to assemble the electromagnetic contactor.

To achieve the foregoing object, according to an aspect of the present invention, provided is an iron core retaining structure of an electromagnetic contactor for retaining a bottom portion of a fixed iron core onto a bottom plate of a lower casing, the fixed iron core having a leg which is inserted into an exciting coil, wherein a convex leaf spring having opposite end portions bent at right angles to form lower pressure-receiving surfaces and side pressure-receiving surfaces respectively is disposed between the fixed iron core and the bottom plate of the lower casing so that the lower pressure-receiving surfaces and the side pressure-receiving surfaces are brought into contact with the bottom plate of the lower casing and with side walls of the lower casing, respectively.

Preferably, buffer materials each having a larger side surface than each of the side pressure-receiving surfaces of the leaf spring are disposed between the side pressure-receiving surfaces formed at opposite end portions of the leaf spring and the side walls of the lower casing.

Preferably, recesses or blind-holes are provided in inner surfaces of the buffer materials so that the bent portions including the lower pressure-receiving surfaces and the side pressure-receiving surfaces formed at the opposite end portions of the leaf spring are closely inserted into the buffer materials, respectively.

Preferably, beam portions capable of being bent at right angles are formed respectively in the side walls of the lower casing with which the side pressure-receiving surfaces formed at the opposite end portions of the leaf spring are in contact.

In the iron core retaining structure of an electromagnetic contactor according to the present invention, a convex leaf spring having opposite end portions bent at right angles to form lower pressure-receiving surfaces and side pressure-receiving surfaces respectively is disposed between the fixed iron core and the bottom plate of the lower casing so that the lower pressure-receiving surfaces and the side pressure-receiving surfaces are brought into contact with the bottom plate of the lower casing and with side walls of the lower casing, respectively. Accordingly, when the movable iron core collides against the fixed iron core, the leaf spring bends greatly to thereby absorb the impact force acting on the fixed iron core, and, at the same time, diffuse the impact force to the bottom plate of the lower casing through the lower pressure-receiving surfaces and to the side walls of the lower casing through the side pressure-receiving surfaces. Accordingly, impact force due to the collision of the movable iron core against the fixed iron core, particularly, impact force acting on the bottom plate of the lower casing in which the electromagnetic contactor mounting portions are provided, is reduced.

Further, buffer materials each having a larger side surface than each of the side pressure-receiving surfaces of the leaf spring may be disposed between the side pressure-receiving surfaces formed at opposite end portions of the leaf spring and the side walls of the lower casing. Accordingly, when the movable iron core collides against the fixed iron core, impact force from the side pressure-receiving surfaces is diffused to the side walls of the lower casing by the buffer materials. Consequently, even side walls having small withstanding pressure can be used safely.

Furthermore, recesses may be provided in inner surfaces of the buffer materials so that the bent portions including the lower pressure-receiving surfaces and the side pressure-receiving surfaces formed at the opposite end portions of the leaf spring are closely inserted into the buffer materials, respectively. Accordingly, the leaf spring and the buffer materials formed at the opposite end portions of the leaf spring are connected to each other so as to be united into one body, so that assembling of the leaf spring and the two buffer materials into the lower casing is made easy.

Moreover, beam portions capable of being bent in the direction perpendicular to the side walls of the lower casing are further formed respectively in the side walls of the lower casing with which the side pressure-receiving surfaces formed at the opposite end portions of the leaf spring are in contact. Accordingly, when the movable iron core collides against the fixed iron core, impact force from the side pressure-receiving surfaces is absorbed by the bending or flexion of the beam portions. Consequently, even side walls having small withstanding pressure may be used safely.

DETAILED DESCRIPTION OF THE PREFERRED EMBODIMENTS

Figure 1A:
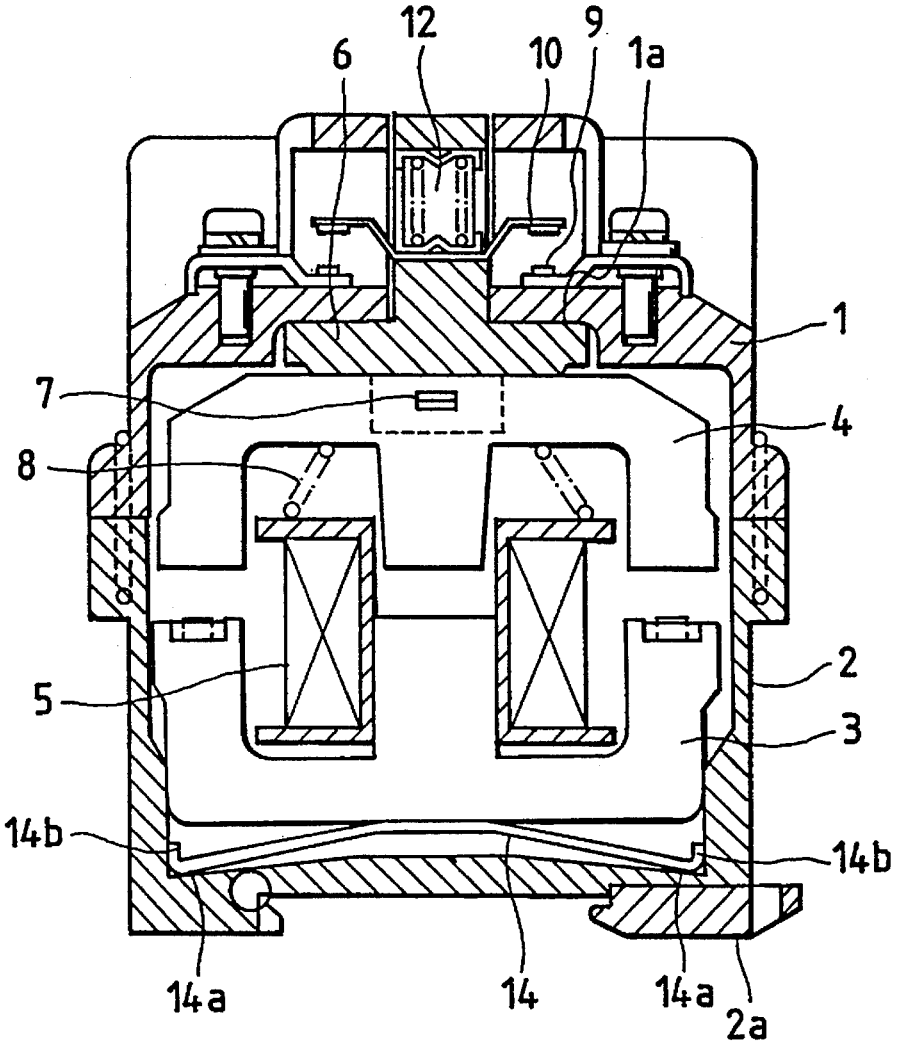
FIG. 1(*a*) is a sectional view of an iron core retaining structure of an electromagnetic contactor according to an embodiment of the present invention, and FIG. 1(*b*) is a perspective view of a leaf spring depicted in FIG. 1(*a*).
Figure 1B:
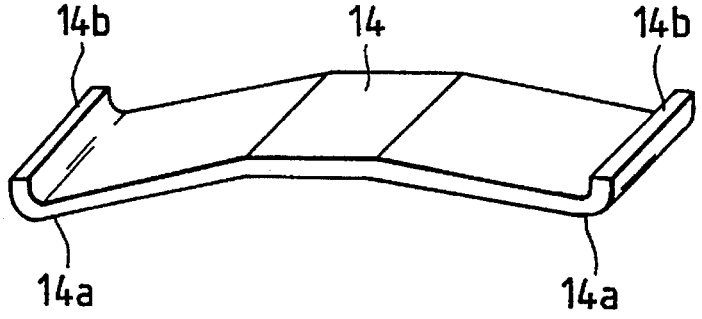

FIGS. 1(*a*) and 1(*b*) show an embodiment of an iron core retaining structure of an electromagnetic contactor according to the present invention, wherein FIG. 1(*a*) is a sectional view of the structure and FIG. 1(*b*) is a perspective view of a leaf spring 14 depicted in FIG. 1(*a*). A point of difference between the embodiment shown in FIG. 1(*a*) and the conventional case shown in FIG. 5(*a*) is in that the elastic sheet 13 of FIG. 5(*a*) is replaced by a convex leaf spring 14 in FIG. 1(*a*). As seen in the drawings, the opposite end portions of the convex leaf spring 14 are bent upward substantially at right angles so as to form lower pressure-receiving surfaces 14*a* and side pressure-receiving surfaces 14*b*. The side pressure-receiving surfaces 14*b* are in slight contact with side walls, respectively, of a lower casing 2.

When an exciting coil 5 is energized with an electric current, that is, when a movable iron core 4 moves to and collides against a fixed iron core 3, the fixed iron core 3 is pressed against the convex portion of the leaf spring 14 by impact force due to the collision. At this time, the leaf spring 14 bends greatly to thereby absorb the impact force acting on the fixed iron core 3 and, at the same time, diffuse the impact force to a bottom plate of the lower casing 2 through the lower pressure-receiving surfaces 14*a* and to the side walls of the lower casing 2 through the side pressure-receiving surfaces 14*b*.

That is, because the leaf spring 14 bends greatly to thereby absorb the impact force acting on the fixed iron core 3 and diffuse the impact force to the bottom plate and side walls of the lower casing 2, the impact force acting on the bottom plate of the lower casing 2 on which electromagnetic contactor mounting portions 2*a* are provided is reduced remarkably. Accordingly, when the electromagnetic contactor is mounted onto a panel, not only the impact against the panel but also noises generated are reduced.

Figure 5A:
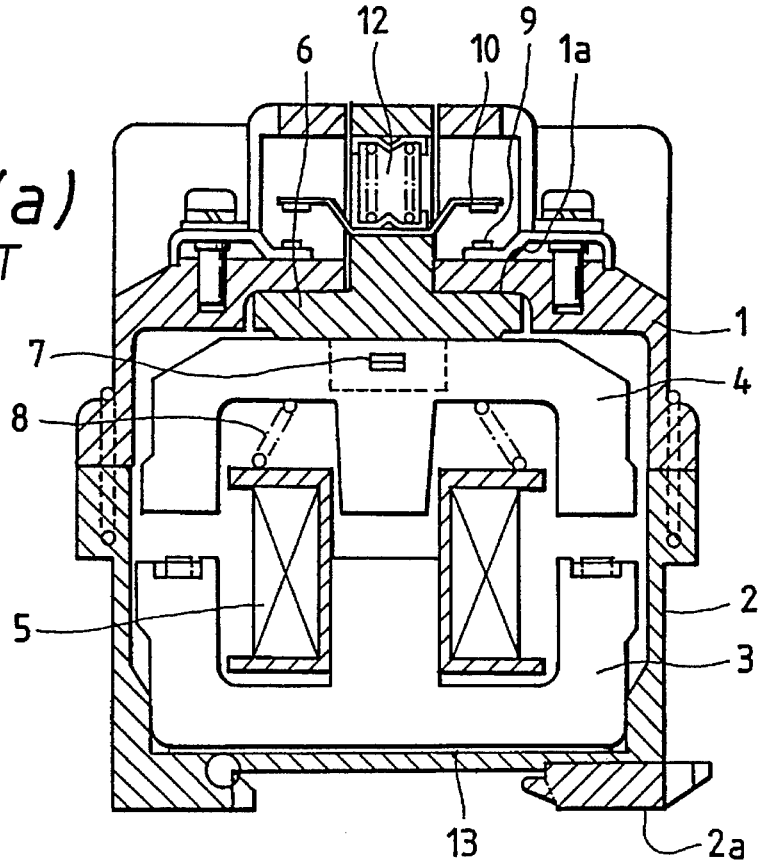
FIG. 5(a) PRIOR ART
FIG. 5(*a*) is a sectional view of an example of a conventional iron core retaining structure of an electromagnetic contactor, and FIG. 5(*b*) is a sectional view of the structure in a making state for explaining the operation of the electromagnetic contactor.
Figure 5B:
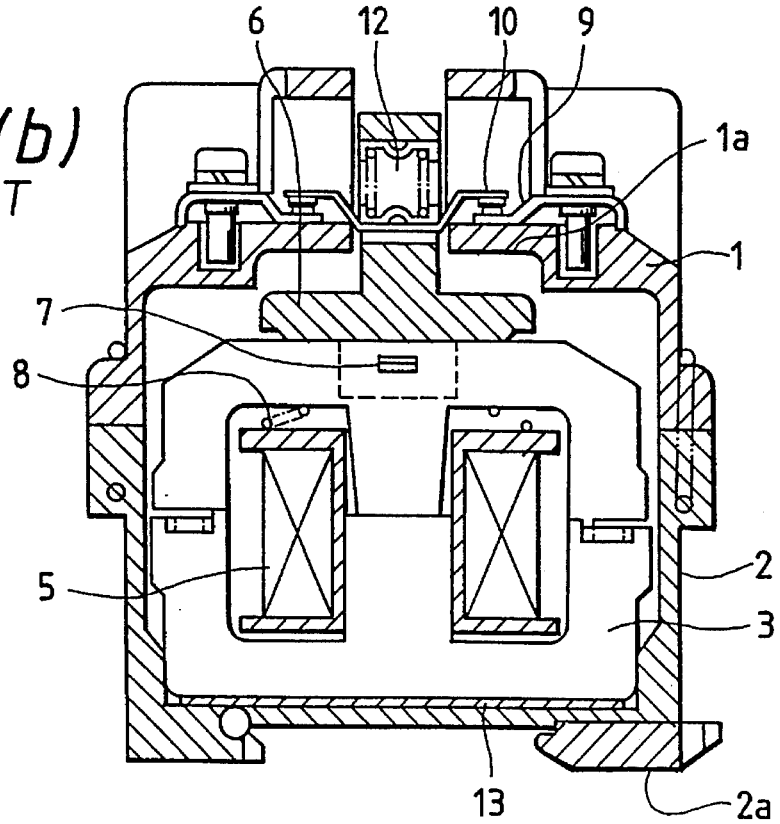
FIG. 5(b) PRIOR ART

Incidentally, other structures and operations of the present invention are the same as those of the conventional case shown in FIGS. 5(*a*) and 5(*b*).

Figure 2A:
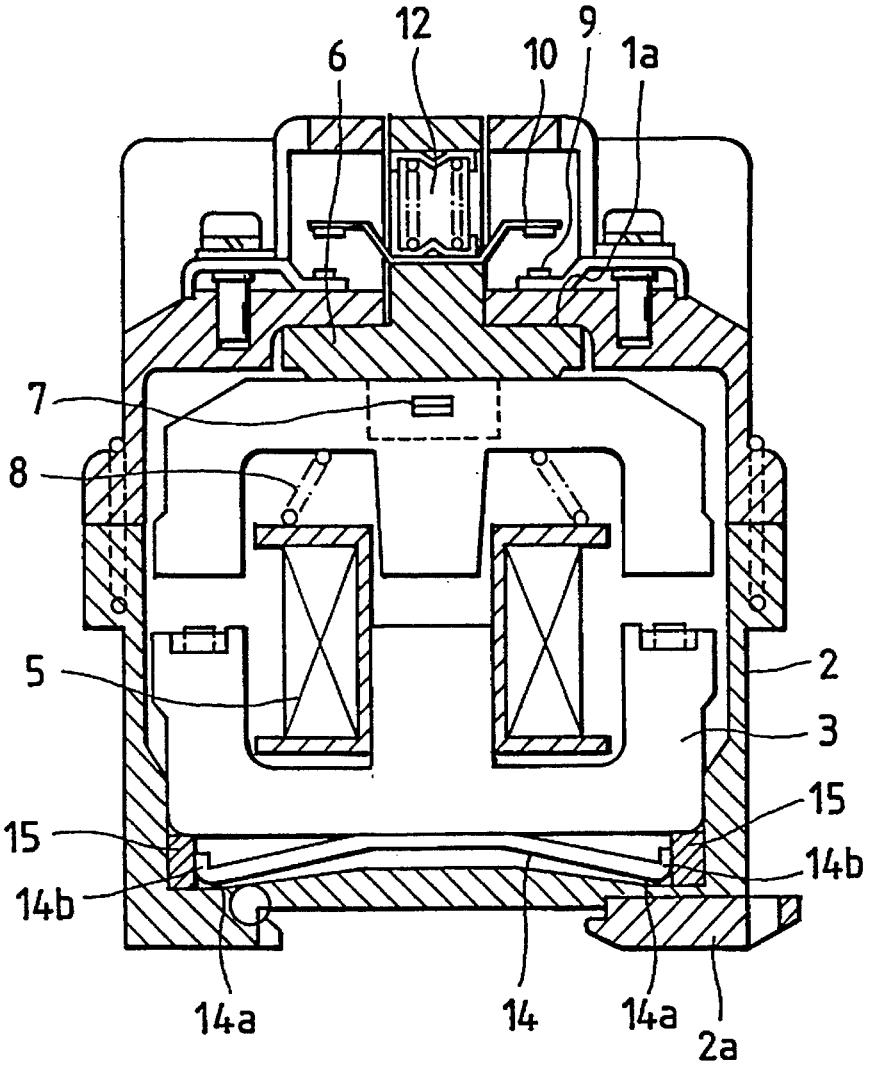
FIG. 2(*a*) is a sectional view of an iron core retaining structure of an electromagnetic contactor according to another embodiment of the present invention, and FIG. 2(*b*) is a perspective view of a leaf spring and opposite side members depicted in FIG. 2(*a*).
Figure 2B:
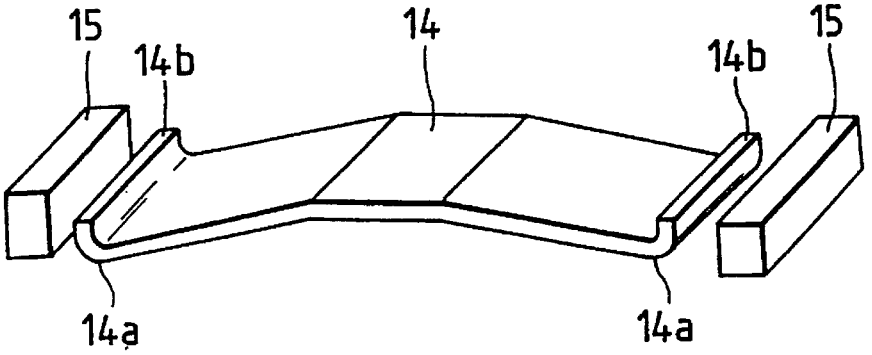

FIGS. 2(*a*) and 2(*b*) show another embodiment of the iron core retaining structure according to the present invention, wherein FIG. 2(*a*) is a sectional view of the structure, and FIG. 2(*b*) is a perspective view of a leaf spring 14 and side members 15 depicted in FIG. 2(*a*). A point of difference between the embodiment shown in FIG. 2(*a*) and the embodiment shown in FIG. 1(*a*) is in that buffer materials 15 each having a larger side surface in area than each side pressure-receiving surface 14*b* of the leaf spring 14 are provided respectively between the side pressure-receiving surfaces 14*b* of the leaf spring 14 and the side walls of the lower casing 2 in FIG. 2.

When impact force acting on the fixed iron core 3 is exerted to the convex portion of the leaf spring 14, not only the impact force is absorbed by the great bending of the leaf spring 14 but also the impact force is diffused to the bottom plate of the lower casing 2 through the lower pressure-receiving surfaces 14*a* and to the side walls of the lower casing 2 through the side pressure-receiving surfaces 14*b*. Because each of the side walls of the lower casing 2 is generally thinner than the bottom plate of the lower casing 2 so that the former has smaller withstanding pressure than the latter, buffer materials 15 each having a larger side surface than each side pressure-receiving surface 14*b* are provided in this embodiment so that the impact force from the side pressure-receiving surfaces 14*b* is diffused. That is to say, the buffer materials 15 contributes to absorbing the impact force exerted onto the side walls of the lower casing 2. Consequently, even side walls having small withstanding pressure may be used safely.

Figure 3A:
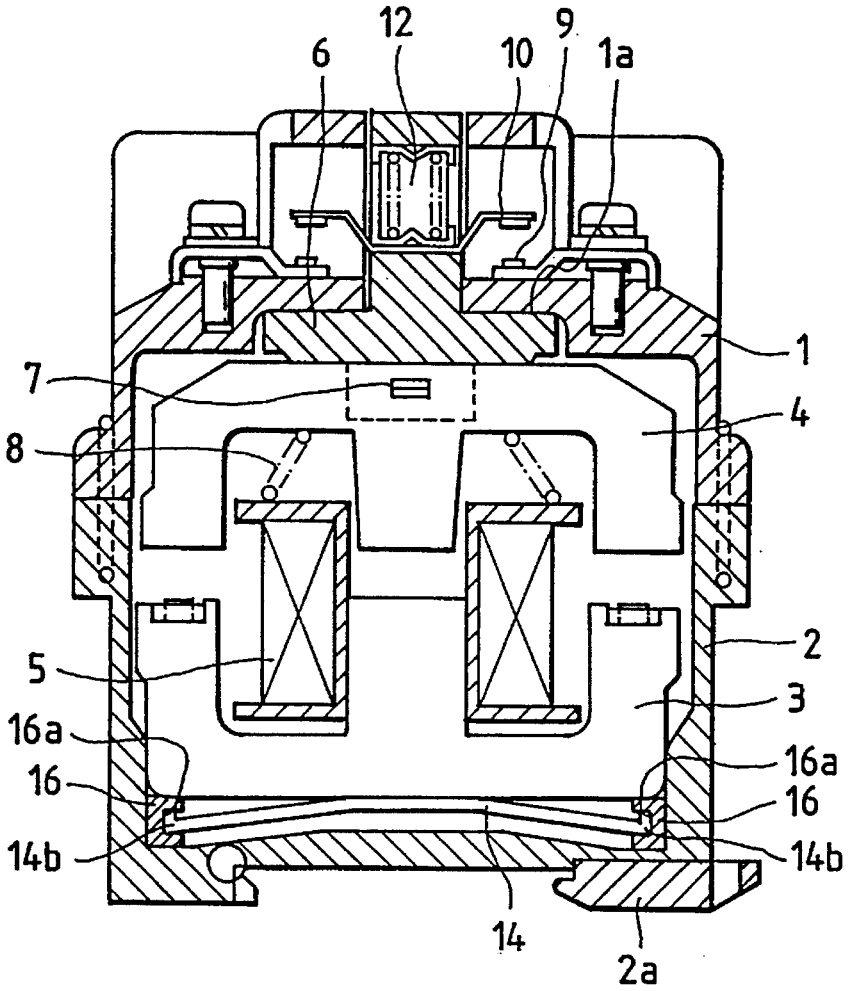
FIG. 3(*a*) is a sectional view of an iron core retaining structure of an electromagnetic contactor according to a further embodiment of the present invention, and FIG. 3(*b*) is a perspective view of a leaf spring and opposite side members depicted in FIG. 3(*b*).
Figure 3B:
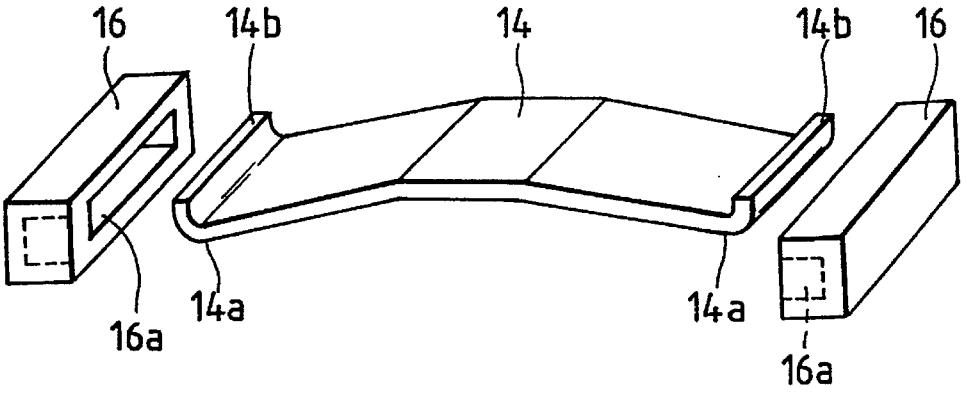

FIGS. 3(*a*) and 3(*b*) show a further embodiment of the iron core retaining structure according to the present invention, wherein FIG. 3(*a*) is a sectional view of the structure, and FIG. 3(*b*) is a perspective view of a leaf spring 14 and buffer materials 16 depicted in FIG. 3(*a*). A point of difference between the embodiment shown in FIG. 3(*a*) and the embodiment shown in FIG. 2(*a*) is in that the buffer materials 15 in FIG. 2(*a*) are replaced by buffer materials 16 in FIG. 3(*a*). The buffer materials 16 are provided with recesses or blind-holes 16*a*, respectively, which are formed in the inner surfaces of buffer materials like the buffer materials 15 in FIG. 2(*a*) so that bent portions where the lower pressure-receiving surfaces 14*a* and the side pressure-receiving surfaces 14*b* are formed at the opposite end portions of the leaf spring 14 are closely inserted into the recesses 16*a*, respectively.

Although the embodiment in FIG. 2(*a*) is generally assembled such that the respective buffer materials 15 are disposed at the opposite side ends of the bottom plate of the lower casing 2 before the leaf spring 14 is inserted into the lower casing 2 from the upper portion, the embodiment in FIG. 3(*a*) is generally assembled such that bent portions where the lower pressure-receiving surfaces 14*a* and the side pressure-receiving surfaces 14*b* are formed at the opposite end portions of the leaf spring 14 are closely inserted into the recesses 16*a*, respectively, of the buffer materials 16 to form the leaf spring 14 and the buffer as one unit, and then the unit of the leaf spring 14 and the buffer materials 16 is inserted into the lower casing 2 from the upper portion. Accordingly, the embodiment in FIG. 3(*a*) has an advantage in that easy assembling such as automatic assembling can be made.

Figure 4A:
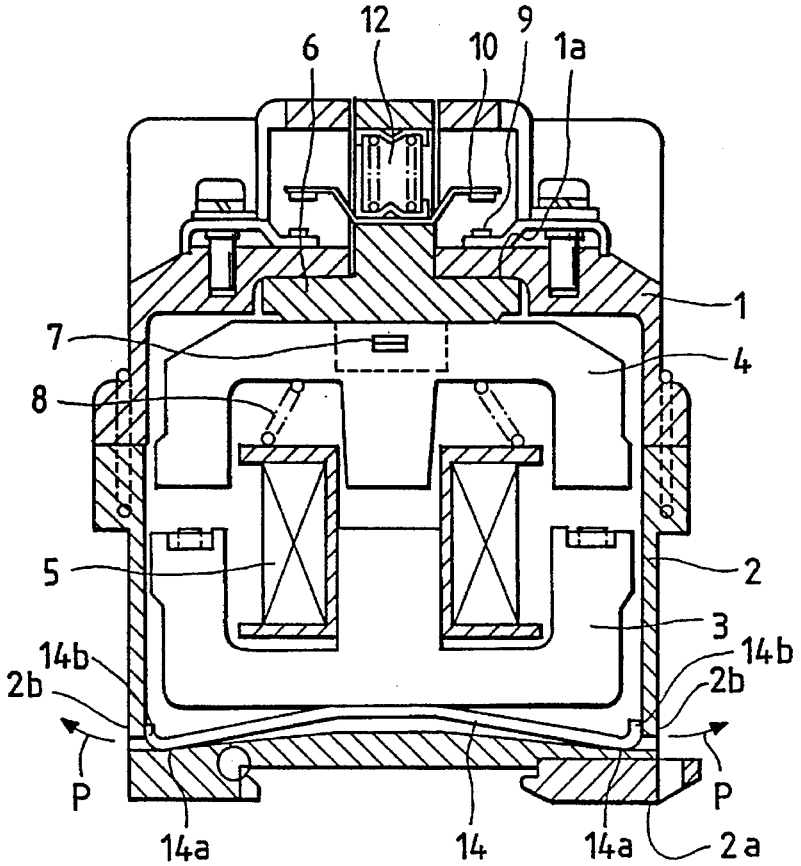
FIG. 4(*a*) is a sectional view of an iron core retaining structure of an electromagnetic contactor according to a yet further embodiment of the present invention, FIG. 4(*b*) is a perspective view of important part of the structure depicted in FIG. 4(*a*), and FIG. 4(*c*) is a perspective view of a leaf spring depicted in FIG. 4(*a*).
Figure 4B:
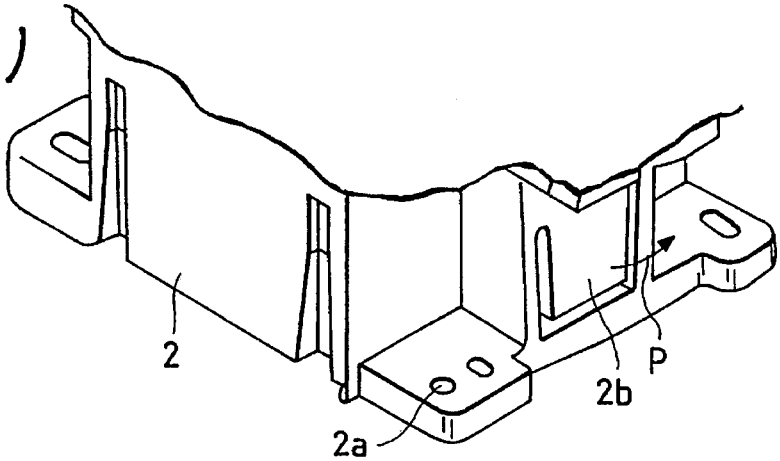
Figure 4C:
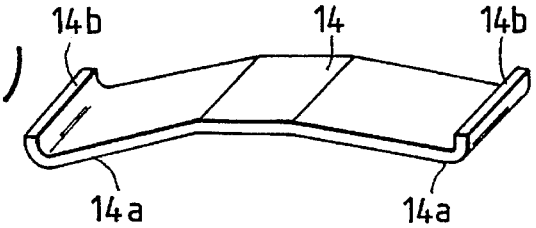

FIGS. 4(*a*), 4(*b*) and 4(*c*) show a further embodiment of the iron core retaining structure according to the present invention, wherein FIG. 4(*a*) is a sectional view of the structure, FIG. 4(*b*) is a perspective view of important part of the structure depicted in FIG. 4(*a*), and FIG. 4(*c*) is a perspective view of a leaf spring 14 depicted in FIG. 4(*a*). A point of difference between the embodiment shown in FIG. 4(*a*) and the embodiment shown in FIG. 1(*a*) is in that U-shaped slits are formed in the side walls, respectively, of the lower casing in FIG. 4(*a*) so that beam portions 2*b* capable of being bent in the direction of the arrow P, that is, capable of being bent perpendicularly with respect to the side walls of the lower casing 2, are formed in the side walls, respectively, of the lower casing 2 against which the side pressure-receiving surfaces 14*b* of the leaf spring 14 are in contact, respectively.

When impact force from the fixed iron core 3 is exerted onto the convex portion of the leaf spring 14, the impact force is absorbed by the great bending of the leaf spring 14 and, at the same time, the impact force is diffused to the bottom plate of the lower casing 2 through the lower pressure-receiving surfaces 14*a* and to the side walls of the lower casing 2 through the side pressure-receiving surfaces 14*b*. The impact force exerted onto the side walls of the lower casing 2 through the side pressure-receiving surfaces 14*b* is absorbed by the bending in the direction of the arrow P of the beam portions 2*b* provided in the side walls of the lower casing 2. Consequently, even side walls having small withstanding pressure may be used safely.

In the iron core retaining structure of an electromagnetic contactor according to the present invention, impact force due to the collision of the movable iron core against the fixed iron core in the electromagnetic contactor, especially, impact force against the bottom plate of the lower casing where the electromagnetic contactor mounting portions are provided, is reduced. Accordingly, when the electromagnetic contactor is mounted onto a panel, both the impact force and noises given to the panel are reduced so that other devices mounted on the same panel are free from the adverse effect of the impact force. In addition, assembling of the iron core retaining structure may be carried out easily similarly to the assembling in the conventional structure.

What is claimed is:

1. An iron core retaining structure of an electromagnetic contactor for retaining a bottom portion of a fixed iron core onto a bottom plate of a lower casing, said structure comprising:

a convex leaf spring having opposite end portions bent at substantially right angles to form lower pressure-receiving surfaces and side pressure-receiving surfaces respectively, the convex leaf spring being disposed between the fixed iron core and the bottom plate of the lower casing so that the lower pressure-receiving surfaces and the side pressure-receiving surfaces are brought into contact with the bottom plate of the lower casing and with side walls of the lower casing, respectively; and flexible beam portions formed respectively in the side walls of the lower casing so that the side pressure-receiving surfaces formed at the opposite end portions of the leaf spring are in contact with the flexible beam portions, respectively, the beam portions being configured to flex in a direction substantially perpendicular to the side walls.

2. An iron core retaining structure of an electromagnetic contactor according to claim 1, wherein said beam portions are defined by U-shaped slits formed through said side walls.

3. An iron core retaining structure of an electromagnetic contactor for retaining a bottom portion of a fixed iron core onto a bottom plate of a lower casing, said structure comprising:

a convex leaf spring having opposite end portions bent at substantially right angles to form lower pressure-receiving surfaces and side pressure-receiving surfaces respectively, the convex leaf spring being disposed between the fixed iron core and the bottom plate of the lower casing so that the lower pressure-receiving surfaces and the side pressure-receiving surfaces are brought into contact with the bottom plate of the lower casing and with side walls of the lower casing, respectively, the convex leaf spring being entirely disposed within a space defined between the bottom portion of the fixed iron core and the bottom plate of the lower casing.

4. An iron core retaining structure of an electromagnetic contactor for retaining a bottom portion of a fixed iron core onto a bottom plate of a lower casing, said structure comprising:

a convex leaf spring having opposite end portions bent at substantially right angles to form lower pressure-receiving surfaces and side pressure-receiving surfaces respectively, the convex leaf spring being disposed between the fixed iron core and the bottom plate of the lower casing so that the lower pressure-receiving surfaces and the side pressure-receiving surfaces are brought into contact with the bottom plate of the lower casing and with side walls of the lower casing, respectively, wherein the opposite end portions are spaced from contact with the fixed iron core.

5. An iron core retaining structure of an electromagnetic contactor for retaining a bottom portion of a fixed iron core onto a bottom plate of a lower casing, said structure comprising:

a convex leaf spring having opposite end portions bent at substantially right angles to form lower pressure-receiving surfaces and side pressure-receiving surfaces respectively, the convex leaf spring being disposed between the fixed iron core and the bottom plate of the lower casing so that the lower pressure-receiving surfaces and the side pressure-receiving surfaces are brought into contact with the bottom plate of the lower casing and with side walls of the lower casing, respectively, an intermediate portion of the convex leaf spring located between the opposite end portions being positioned above the opposite end portions to be the sole portion of the convex leaf spring in contact with the fixed iron core.

6. An iron core retaining structure of an electromagnetic contactor for retaining a bottom portion of a fixed iron core onto a bottom plate of a lower casing, said structure comprising:

a convex leaf spring having opposite end portions bent at substantially right angles to form lower pressure-receiving surfaces and side pressure-receiving surfaces respectively, the convex leaf spring being disposed between the fixed iron core and the bottom plate of the lower casing so that the lower pressure-receiving surfaces and the side pressure-receiving surfaces are brought into contact with the bottom plate of the lower casing and with side walls of the lower casing, respectively, the side pressure-receiving surfaces being substantially planar, and extending to reach respective terminuses of the convex leaf spring.

7. An iron core retaining structure of an electromagnetic contactor for retaining a bottom portion of a fixed iron core onto a bottom plate of a lower casing, said structure comprising:

a convex leaf spring having opposite end portions bent at substantially right angles to form lower pressure-receiving surfaces and side pressure-receiving surfaces respectively, the convex leaf spring being disposed between the fixed iron core and the bottom plate of the lower casing; and buffer materials respectively disposed between the side pressure-receiving surfaces of the leaf spring and side walls of the lower casing.

8. An iron core retaining structure according to claim 7, wherein each of the buffer materials has a side surface larger in area than each of the side pressure-receiving surfaces, the side surface of the each buffer material being brought into contact with the respective side pressure-receiving surface.

9. An iron core retaining structure of an electromagnetic contactor according to claim 7, wherein recesses are provided in inner surfaces of the buffer materials so that the bent portions including the lower pressure-receiving surfaces and the side pressure-receiving surfaces formed at the opposite end portions of the leaf spring are closely inserted into the buffer materials, respectively.

10. An iron core retaining structure according to claim 9, wherein the buffer materials floatingly supports the convex leaf spring with respect to the bottom plate of the lower casing.

11. An iron core retaining structure according to claim 7, wherein the buffer materials are brought into contact with the bottom portion of the fixed iron core.

* * * * *